United States Patent [19]

Lanussé

[11] 3,943,591

[45] Mar. 16, 1976

[54] FLUID-PRODUCT PROJECTION APPARATUS FOR MAINTENANCE OF VARIOUS ARTICLES

[76] Inventor: Marie Marguerite Lanussé, 50, rue Pierre Charron, Paris 75008, France

[22] Filed: June 11, 1974

[21] Appl. No.: 478,398

[30] Foreign Application Priority Data

June 14, 1973 France ..... 73.21712

[52] U.S. Cl. ..... 15/29

[51] Int. Cl.[2] ..... A46B 13/04

[58] Field of Search ..... 15/22 R, 24, 29, 97; 51/170 PT, 170 T

[56] References Cited

UNITED STATES PATENTS

| | | | |
|---|---|---|---|
| 3,065,477 | 11/1962 | McKechnie | 15/29 |
| 3,443,272 | 5/1969 | Trelc et al. | 15/29 |
| 3,638,264 | 2/1972 | Walton | 15/29 X |
| 3,658,432 | 4/1972 | Lanusse | 15/24 X |

*Primary Examiner*—Edward L. Roberts

*Attorney, Agent, or Firm*—Haseltine, Lake & Waters

[57] ABSTRACT

Liquid-projecting apparatus for cleaning various articles, the apparatus including a body forming a container and a brush member mounted thereon. Provision is made in the body for injecting the liquid in the brush member while this latter is rotating.

5 Claims, 7 Drawing Figures

FLUID-PRODUCT PROJECTION APPARATUS FOR MAINTENANCE OF VARIOUS ARTICLES

FIELD OF THE INVENTION

The present invention relates generally to apparatus for cleaning and maintaining various articles and concerns more particularly apparatuses in which a fluid is projected into a rotating brush or like member for applying various products to any surface while at the same time cleaning the same.

The invention relates more precisely to two categories of apparatus of the above-mentioned type, i.e. apparatus of simplified technological design for applying any product, such as paint or the like, and more elaborate apparatus for maintaining various articles, such as foot-wear, furniture, glass panes, floor coverings and generally all substantially plane surfaces, requiring regular maintenance in order to keep a pleasant clean appearance.

BACKGROUND

The hitherto known rotating brush apparatus for the maintenance of, for example, floor coverings and floorings were adapted to deposit a certain amount of liquid product, such as wax, on the surface to be cleaned and/or polished. However, such apparatus is relatively heavy, difficult to handle and rather large-sized. On the other hand, small apparatus is known which can be held in one's hand and are equipped with a rotating brush or like member for scouring or polishing various surfaces. However, apparatus of this type was not provided with means for injection of a fluid product into the rotating brush member and it was necessary to previously apply a suitable fluid product on the surface to be cleaned before using the apparatus proper. This considerably increased the working time and, moreover, this type of apparatus could not be used with, for example, quick-drying products which had to be simultaneously applied, spread and brushed on the surface concerned.

SUMMARY OF THE INVENTION

The present invention allows all the aforementioned drawbacks of the apparatus of the prior art to be remedied by providing small apparatus which, being held in the hand, can be used for the maintenance of any surface and notably insure a rational projection of the fluid product into a rotating brush member, which fluid product can, if appropriate, be treated, for example heated, directly in the apparatus.

More precisely, the present invention has for its object a fluid product projection apparatus for maintenance of various articles, of the type comprising a body, part of which forms a container for the fluid product, as well as means for the supply of the said fluid product to a working head mounted on the said body, characterized in that the said working head is constituted by at least one member provided with bristles forming a brush or the like and driven in rotation by a motor, means for projecting the said fluid product being provided in the said body to inject the same into the said bristle member while the latter itself is rotating.

According to another feature of the invention, the said projection means are constituted by a conduit with bores provided in the said member and opening at the root of the bristles carried by the said member, whereas a pump driven by a first electric motor is associated, on the one hand, with the said conduit and, on the other hand, with a suction pipe running into the said container.

According to still another feature of the invention, the said member is provided at its end opposite the one carrying the bristles with a toothed wheel meshing with a pinion driven by a second electric motor.

It is thus understood that, by means of these very simple arrangements, the brush member can be made to rotate while at the same time injecting a certain amount of product, or without injecting the product, the two said small electric motors being operated separately or simultaneously, as known per se, by means of a small two-position button mounted on a handle for holding the apparatus.

According to another feature of the invention, the bristles at the end of the said rotating member are secured to a support adapted to be removably fitted onto the said member by means of a system consisting of a retractable pin engaging a hole provided in the said support.

Of course, the support carrying the bristles may as well be mounted stationarily at the end of the body of the apparatus without departing from the scope of the invention.

According to still another feature of the invention, the said projection means are constituted by a hollow shaft driven by an electric motor and carrying at one of its ends a brush or like member which, if appropriate, is removable, whereas at the other end of the said hollow shaft opens a suction pipe running into the container, and arrives a certain amount of air sucked from the outside by a small centrifugal turbine mounted within the apparatus and also driven by the said motor.

The said turbine therefore produces a blast-pumping effect enabling the liquid to be sucked from the container while at the same time dividing and projecting the same into the brush bristles. It should be noted that such an arrangement is particularly simple and judicious, for when the brush is firmly pressed on the surface to be treated, the hollow shaft is, somewhat obturated by the said surface and the whole bulk of bristles, so that less air flow is sucked. Maximum fluid projection is obtained simply by moving the rotating brush, i.e. the apparatus, from the said surface to restore a maximum flow of sucked air. Consequently, according to whether the brush, i.e. the apparatus, is moved from or towards the surface to be treated, more or less fluid projection is obtained. This is of particular interest where the surfaces to be treated are non-uniformly dirty, i.e. require more product and/or brushing time in some areas.

The above-mentioned advantages are obtained, according to the invention, by the fact that the said centrifugal turbine is enclosed in a body connected to the said other end of the hollow shaft through a rotary joint and that the suction pipe end opposite the one located in the container penetrates into the body of the turbine, thus enabling the said blast-pumping effect to be obtained.

According to still another feature of the invention, the turbine body comprises an air-suction sleeve portion opening onto a wall of the apparatus provided at that point with a small protection grid.

According to still another feature of the invention, a small heating resistance is mounted in the said suction sleeve for heating the sucked air.

It should also be noted that, according to the invention, at least one heating resistance is provided in the container, whereas a thermostat adapted to be controlled from outside the apparatus is mounted on the wall of the said container.

According to another embodiment of the invention, two hollow shafts equipped respectively with a brush member may be provided in an apparatus of the aforesaid type, the aforesaid motor driving both shafts simultaneously, whereas a collector is connected to the body of the turbine for sucking and projecting the fluid product.

In order to increase the efficiency of the apparatus, the brush member may, according to the invention, be provided with only a ring of bristles around the orifice or orifices through which the fluid product is delivered. Thus, if the fluid product is finely divided, the bristles will not interfere with the spreading of the fluid on the surface to be treated before the brushing proper.

BRIEF DESCRIPTION OF THE DRAWINGS

Other purposes and advantages of the invention will appear more clearly from the following detailed description made with reference to the appended drawings in which.

DETAILED DESCRIPTION

Figure 1:
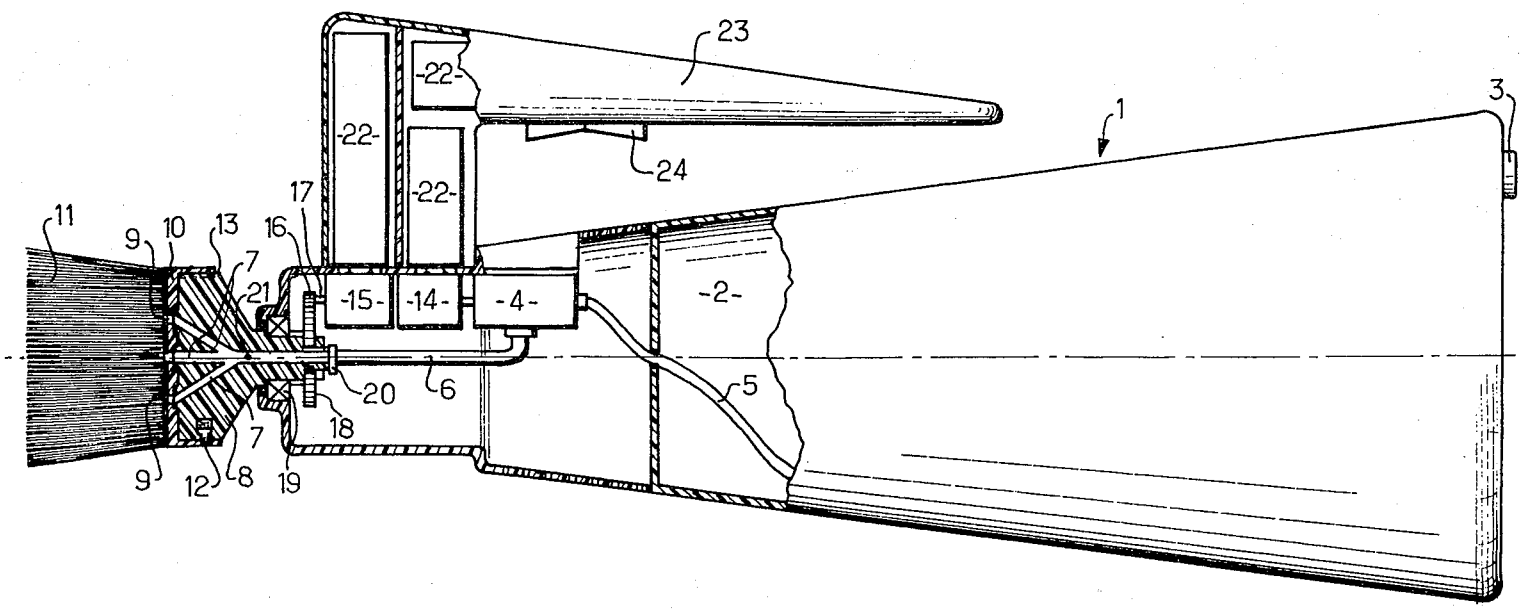
FIG. 1 is an elevational side view, with parts broken away, illustrating a first form of the apparatus according to one embodiment of the invention.

According to a first embodiment as shown in FIG. 1, an apparatus according to the invention is seen to comprise a body 1, part of which forms a container 2 provided with a filling orifice obturable by a plug 3 at the rear of the apparatus. In the front narrower portion of the body 1 is mounted a pump 4 associated, on the one hand, with a preferably supple suction pipe 5 running into the container 2 and, on the other hand, with a conduit 6 extended by bores 7 provided in a rotary member 8 and opening at 9 into a support forming a sleeve 10, carrying bristles 11 and removably mounted on the rotary member by means of a retractable pin 12. The retractable pin is inserted in the rotary member 8 and acted upon by a spring so as to be automatically engaged into a hole provided in the brush support 10. At 13 is shown a groove provided in the member 8 and co-operating with the support 10 to allow the said support to rotate jointly with the member 8.

At 14 is shown a first electric drive motor for pump 4. A second electric drive motor for the rotating member or working head 8 is shown at 15. The latter driving takes place through a pinion 16 mounted on the output shaft 17 of the motor 15 and meshing with a toothed wheel 18 rotating jointly with the member 8, which rotates in a roller bearing 19 mounted at the end of the body 1 of the apparatus. At 20 is shown a rotary joint connecting the conduit 6 to the channel 21 with bores 7 provided in the rotating brush member 8. Motors 14 and 15 may be supplied for example from storage batteries shown diagrammatically at 22 and housed in a handle 23 allowing the apparatus to be held conveniently and including a two-position switch for the rotation of the brush with or without fluid injection into the conduit 6, i.e. allowing either the motor 15 to be supplied alone or both motors 14 and 15 to be supplied simultaneously.

Figure 3:
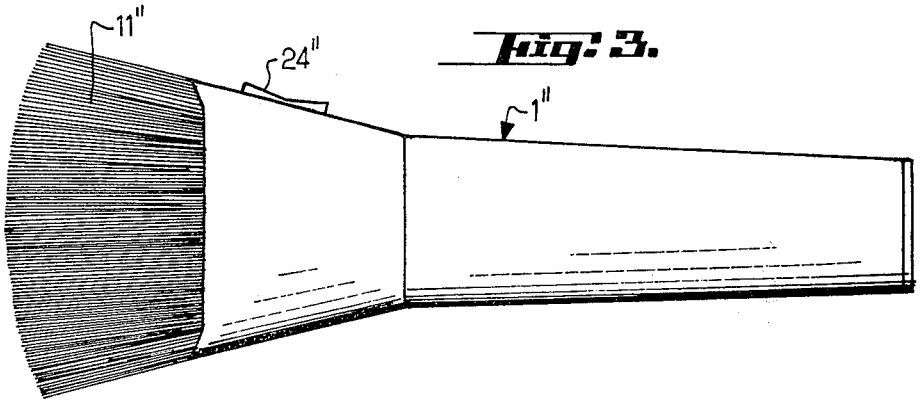
FIG. 3 illustrates another form of apparatus particularly useful for cleaning dishes or the like and scouring pans, and using members similar to as those in FIG. 1.

Such an apparatus is particularly efficient for applying various liquid products, such as, for example, paint. In FIG. 3 is shown an apparatus comprising similar members to those of FIG. 1, but the external shape of which is somewhat different owing to its particular use. Indeed, the apparatus shown in FIG. 3 is particularly useful for cleaning dishes or the like and scouring pans. Like the apparatus shown in FIG. 1, the apparatus of FIG. 3 comprises a body 1'' in which is provided a container, a working head with a rotating brush 11'' and a two-position switch 24'' for the rotation of brush 11'' with or without injection of scouring product.

Figure 2:
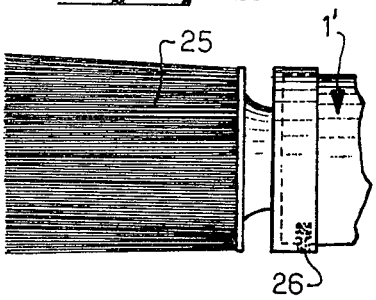
FIG. 2 shows a brush in the form of a stationary paint brush adapted to be mounted on apparatus similar to that of FIG. 1.

FIG. 2 shows a working head which is mounted removably at the end of an apparatus body 1' similar to the one illustrated in FIG. 1, but which is not rotatable. Such a working head 25 is in the form of a paint-brush which is not rotatable and is mounted by means of a simple retractable pin 26 at the end of body 1' is particularly useful for applying more or less viscous liquid coating products such as paint, varnish or the like.

Figure 4:
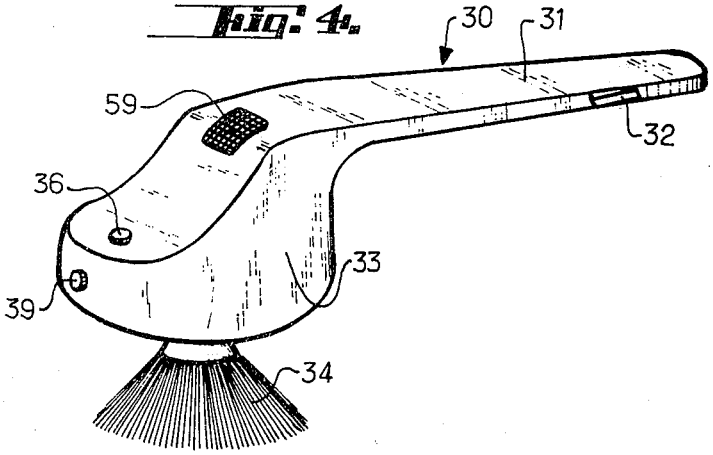
FIG. 4 is a perspective view of a second embodiment of the invention.
Figure 5:
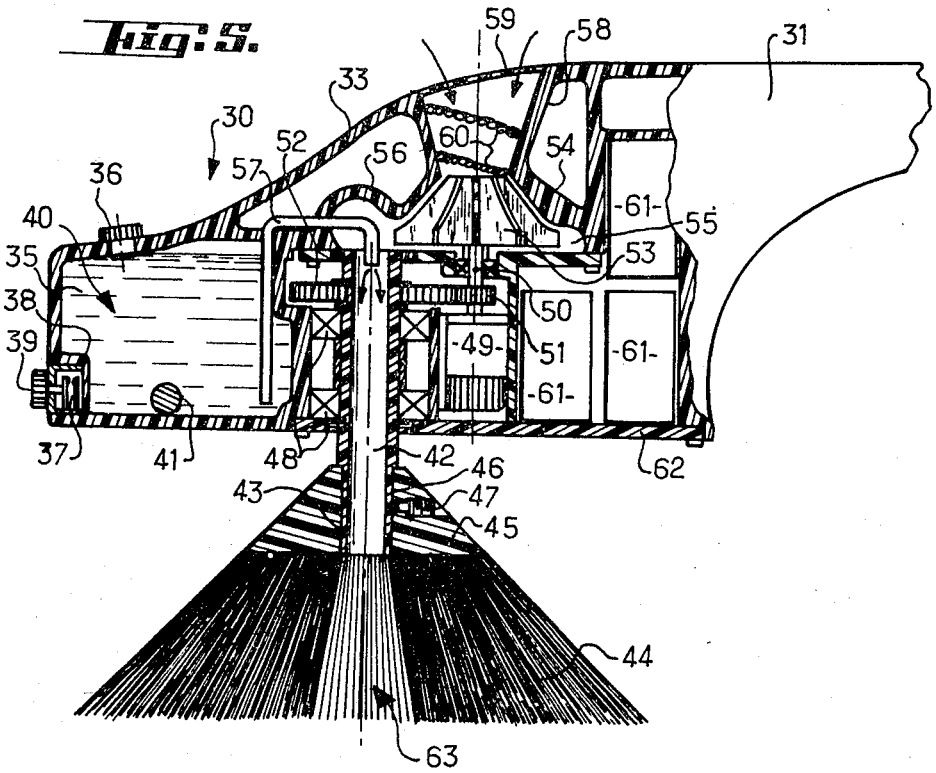
FIG. 5 is a substantially axial sectional view of the apparatus shown in FIG. 4.

Reference is now made to FIGS. 4 and 5 showing a second type of apparatus according to the invention. This apparatus 30 is provided with a handle 31 with a switch 32, the said handle being extended by a body 33 containing the active members of the apparatus, namely fluid projection means as well as means for driving in rotation any form of brush, such as 34.

As appears clearly from FIG. 5, the body 33 comprises a container 35 obturable by a plug 36, a thermostat of a type known per se and shown generally at 37 being mounted on the enclosure 38 of the said container and adapted to be controlled from the outside by means of a knurled button 39. It is thus possible to impart to the fluid 40 in the container 35 a predetermined and appropriate temperature, the said fluid being heated by a cylindrical resistance 41 mounted at the bottom of the container.

The bristles of brush 44 are carried by a support 45 which may be removable and is fitted on the end of a hollow shaft 42. According to the form of embodiment illustrated, the end of the hollow shaft 42 is provided at its periphery with two flat surfaces 43, 46 co-operating with corresponding flat surfaces provided in the support 45, so that the brush 44 reliably rotates jointly with the hollow shaft 42. Additionally, a small screw 47 in the brush support 45 allows the latter to be reliably secured to the end of the hollow shaft 42.

The said hollow shaft rotates in a roller bearing 48 arranged in body 33 and is driven in rotation by a motor 49. The output shaft 50 of motor 49 carries a pinion 51 meshing with a toothed wheel 52 rotating jointly with the hollow shaft 42, the said output shaft 50 also driving in rotation a turbine paddle-wheel 53 enclosed in a body 54. The body 54 has, in a manner known per se, a progressively increasing section so as to form a spiral volute as seen at 55 and 56. The largersection portion 56 of the volute 54, through which the air supplied by the turbine 53 is expelled, is connected to the hollow shaft 42 through the medium of, for example, a rotary joint. Into the portion 56 of the volute 54 opens a pipe 57 running into the container 35. The upper portion of the turbine body 54 forms a funnel-shaped portion 58 opening into the upper portion of the apparatus to allow air to be sucked by the said turbine. At 59 is shown a small protection grid covering the funnel-shaped portion 58. At 60 is shown a small resistance mounted in the funnel-shaped portion 58 for heating the air from outside the apparatus. Lastly, a supply storage battery for motor 49 is shown diagrammatically at 61, the said battery being arranged in a compartment provided in body 33 and accessible through a small trap 62 provided in body 33.

The operation of this apparatus can be readily inferred from the description just made. Motor 49 is started by pressing the switch button 32. The hollow shaft 42 and the turbine 53 are driven in rotation simultaneously. The outside air sucked by the paddle-wheel 53 is conveyed into the hollow shaft 42 and insures a blast-pumping effect causing the fluid contained in the container to be sucked and dispersed in the hollow shaft 42 from the end of the suction pipe 57 opening into the said hollow shaft. This finally results in a projection of divided fluid into the brush 44, which fluid, if appropriate, may be heated to a predetermined temperature owing to the heating resistance 41 in the container and to the thermostat 37. The sucked and expelled air responsible for this projection may be heated by the heating resistances 60 depending upon the product used.

For some fluids it may be useful to employ a brush provided with only a ring of bristles distributed about the outlet of the hollow shaft 42 so as to leave a central region 63 devoid of bristles and allowing the fluid, when finely divided, to properly spread on the surface to be treated without being impeded by the bristles.

It is thus seen that, according to whether the brush is more or less pressed on the surface to be treated, i.e. depending upon the degree to which the apparatus is moved from the said surface, a variable flow of expelled air is obtained, which means that the fluid flow projected into the brush varies accordingly. As has already been pointed out, it is therefore possible with such an apparatus to obtain a quite convenient maintenance of non-uniformly dirty surfaces by simply imparting to the apparatus slight vertical motions, alternately upward and downward.

Figure 6:
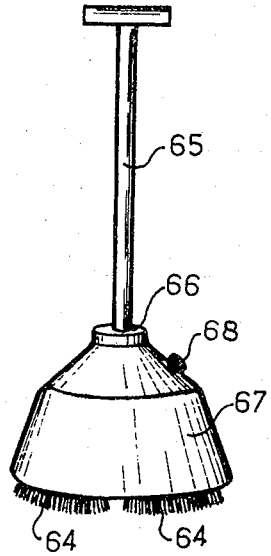
FIG. 6 is a perspective view of a third embodiment of the invention, provided with two brushes.
Figure 7:
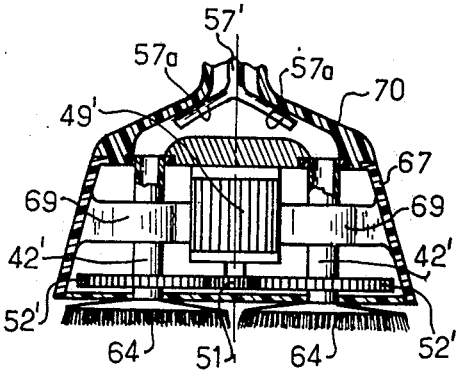
FIG. 7 is a partial and axial sectional view of the apparatus shown in FIG. 6.

Reference is now made to FIGS. 6 and 7 showing another embodiment of the invention, using the same principle as illustrated in FIG. 5.

The apparatus shown in these Figures is particularly adapted for floor maintenance. The same reference numbers with primes as in FIG. 5 are used for similar members.

This apparatus comprises a holding stick 65 mounted at 66, pivotally if appropriate, on a body 67 containing the necessary members for projecting a fluid into two brushes 64 and for driving them in rotation. At 68 is shown a plug for closing the container in the body 67. Since two brushes are provided, the apparatus is equipped, as seen in FIG. 7, with two hollow shafts 42' mounted in the body 67 by means of a member 69 forming a bearing for both shafts and a reinforcing element for the said body. The motor 49 drives both hollow shafts 42 simultaneously through pinnion 51' and a toothed wheel 52' provided on each hollow shaft. A collector element 70 surmounts the hollow shafts 42' and is connected to the turbine body in the manner as illustrated in FIG. 5. There is also provided a fluid suction and projection pipe 57' with two distributing branches 57a opening into the collector element 70.

The invention therefore provides a fluid-projection maintenance apparatus which is compact, simple in design, adapted for a great number of uses, capable of projection fluids or variable viscosity and equipped with either a single or several brushes depending upon its desired purpose.

It should be noted, in this connection, that the apparatus of the type illustrated in FIG. 1 ensures perfect adherence of the brush, or paint-brush, to the surface to be treated, owing to the rotation of said brush which, moreover, minimizes physical effort for the user (no to-and-fro movements). As for the type of apparatus illustrated in FIGS. 4 to 7, it should also be noted that the use of liquid wax at a certain temperature ensures automatic dirt-removal from the various members of the apparatus while at the same time allowing the product vaporized within the brushes to be uniformly distributed. Owing to the heating element provided in such apparatus, it is also possible to use solid natural products, such as cakes of wax or the like.

Of course, the present invention is by no means limited to the embodiments described and illustrated which have been given by way of example only. Thus, any form of brushes can be used, e.g. brushes in the form of paint-brushes or the like or even brushes in the form of disks, without reducing the efficiency of the apparatus in operation. Also, a set of appropriate brushes and glazing or glossing wads can be readily adapted to the apparatus of the invention to carry out any operation from scouring to finish-polishing, in particular without fluid injection. It should also be noted that some of the members of the apparatus, such as, for example, the hollow shaft, may advantageously be made from plastics without departing from the scope of the invention. The invention therefore comprises all technical equivalents to the means described as well as their combinations should the latter be carried out according to the spirit of the invention and reduced to practice within the scope of the following claims.

What is claimed is:

1. A fluid-product projection apparatus for maintenance of various articles comprising a body having a portion which forms a container for a fluid product, a working head rotatably mounted on said body, means for supplying fluid product to said working head, said working head being constituted by at least one rotatable member forming a brush, a motor in said body for for driving the brush in rotation and projecting means for projecting said fluid product into said brush member while the latter is rotating, the projecting means being constituted by at least a hollow shaft driven by said motor and carrying at one of its ends said rotatable member, a suction pipe extending into the container and having an open end extending into said hollow shaft with clearance within the latter and a centrifugal turbine mounted within the apparatus and driven by said motor to blow air through said hollow shaft and draw the fluid product from said container and into and through said hollow shaft.

2. An apparatus according to claim 1 wherein said body is provided with a chamber opening into said hollow shaft and said turbine is enclosed in said chamber.

3. An apparatus according to claim 1, wherein the body comprises an air-suction sleeve externally open and including a protection grid in said sleeve, said sleeve opening into said chamber.

4. An apparatus according to claim 3 comprising a heating resistance mounted in said air-suction sleeve to heat the air passing through the sleeve.

5. An apparatus according to claim 1 comprising at least one heating resistance in the container and a thermostat controllable from outside the apparatus mounted on said container and controlling said resistance.

* * * * *